US005598730A

United States Patent [19]

Dillon

[11] Patent Number: 5,598,730

[45] Date of Patent: Feb. 4, 1997

[54] PRE-FORGE ALUMINUM OXIDE BLASTING OF FORGING BILLETS AS A SCALE RESISTANCE TREATMENT

[75] Inventor: Garry L. Dillon, Gurnee, Ill.

[73] Assignee: Snap-on Technologies, Inc., Crystal Lake, Ill.

[21] Appl. No.: 297,982

[22] Filed: Aug. 30, 1994

[51] Int. Cl.[6] ..... B24C 1/00

[52] U.S. Cl. ..... 72/53; 451/75

[58] Field of Search ..... 72/53; 451/75

[56] References Cited

U.S. PATENT DOCUMENTS

| | | | |
|---|---|---|---|
| 2,239,044 | 12/1938 | Leighton | 72/53 |
| 2,412,058 | 12/1946 | Pfeil . | |
| 3,002,865 | 10/1961 | Johnson . | |
| 3,133,568 | 5/1964 | Reed . | |
| 3,238,072 | 3/1966 | Greene et al. . | |
| 3,573,023 | 3/1971 | Thomas et al. . | |
| 3,672,038 | 6/1972 | Lombard . | |
| 3,754,976 | 8/1973 | Babecki et al. | 72/53 |
| 3,765,923 | 10/1973 | Bender-Christensen . | |
| 3,775,180 | 11/1973 | Hirata et al. . | |
| 3,844,846 | 10/1974 | Friske et al. . | |
| 3,885,995 | 5/1975 | Cunningham et al. . | |
| 4,021,910 | 5/1977 | Freeman, Jr. et al. . | |
| 4,312,900 | 1/1982 | Simpson . | |
| 4,354,371 | 10/1982 | Johnson . | |
| 4,753,094 | 6/1988 | Spears . | |
| 4,944,172 | 7/1990 | Evans . | |
| 5,057,108 | 10/1991 | Shetty et al. . | |
| 5,093,403 | 3/1992 | Rau et al. . | |
| 5,193,375 | 3/1993 | Meister . | |
| 5,212,976 | 5/1993 | Company . | |
| 5,224,367 | 7/1993 | Ahrweiler et al. . | |
| 5,270,081 | 12/1993 | Manier et al. . | |
| 5,277,048 | 1/1994 | Lubas | 72/53 |
| 5,290,364 | 3/1994 | Stein et al. . | |

FOREIGN PATENT DOCUMENTS

| | | | |
|---|---|---|---|
| 645214 | 3/1995 | European Pat. Off. . | |
| 2642337 | 8/1990 | France . | |
| 330917 | 12/1920 | Germany . | |
| 8197215 | 11/1983 | Japan | 72/53 |
| 574088 | 3/1942 | United Kingdom . | |
| 1041620 | 9/1966 | United Kingdom . | |
| 2182352 | 5/1987 | United Kingdom | 72/53 |
| 9408755 | 4/1993 | WIPO . | |
| 9318863 | 9/1993 | WIPO . | |

OTHER PUBLICATIONS

Sinclair Mineral & Chemical Co. Data Sheet for Aluminum Oxide Grit Media.

Acheson Colloids Company Data Sheet for Deltaglaze 347 and Deltaforge 182 Billet Precoating Treatments.

"Improvement in Properties: Additives in Oxidation Resistance" Whittle and Stringer, (Philosophical Transactions of The Royal Society of London, vol. 295, No. 1413, pp. 309–329).

*Primary Examiner*—David Jones

*Attorney, Agent, or Firm*—Emrich & Dithmar

[57] ABSTRACT

A ferrous forging billet is treated before heating for forging by grit blasting it with aluminum oxide grit having a pre-blasting particle size in the range of from about 100 microns to about 180 microns, at a pneumatic pressure in the range of from about 60 psi to about 160 psi, and for a time period in the range of from about 30 seconds to about 60 seconds, so as to remove pre-existing scale from the surface of the billet stock, to roughen the cleaned billet surface and to embed particles of aluminum oxide in the cleaned and roughened billet surface, thereby to form a tightly adhering deposit of aluminum oxide particles which are dispersed over the billet surface and cover at least 10% thereof. This substantially inhibits the formation of oxides on the surface of the billet during heating for forging.

18 Claims, 3 Drawing Sheets

PRE-FORGE ALUMINUM OXIDE BLASTING OF FORGING BILLETS AS A SCALE RESISTANCE TREATMENT

BACKGROUND OF THE INVENTION

1. Field of the Invention

This invention relates generally to methods of surface treatment of ferrous materials, commonly referred to as forging billet stock, and particularly, relates to methods for surface treatment of such stock to inhibit the formation thereon of oxides during heating for forging.

2. Description of the Prior Art

Many products, including hand tools, such as wrenches and the like, are formed by forging. In this process, a hot-rolled bar formed of a suitable ferrous alloy, such as a suitable steel, which bar constitute forging billet stock, is heated to a forging temperature, typically in the range of from about 1500° F. to about 2300° F., and forged in forging dies. Then, the forged billet passes through a trim station to remove excess material, thereby forming the forged part or "forging." The forged part then typically undergoes a number of finishing processes to produce the desired quality of surface finish on the part. It is important that the surface finish quality and consistency of the as-forged part be as good as possible to minimize the extent of post-forging finishing operations. To this end, trim punches are carefully designed to eliminate marks created during trimming and the forging dies may be polished to eliminate the transfer of machining marks on the dies to the forged part.

Typically, hot rolled billet stock, as received from the mill, has surface oxidation scale which can adversely affect the surface condition of the forged part. This scale can be removed by a number of known methods, including centerless grinding with abrasive wheels or belts, steel grit and steel shot blasting, glass beading, slag blasting, drawing or bending and machining. However, even though mill scale may be cleaned from the billet stock by these methods, the heating of the cleaned billet in air to a forging temperature results in the rapid growth of additional thick oxide surface layers, typically characterized by high variability of thickness and non-uniform adherence. These oxidation layers require additional processing to remove them from the forged part. Thus, the oxidation layers may be forged into the surface of the part, to varying depths, resulting in an uneven and inconsistent surface finish. In order to bring the surface of the forged part to a required quality and consistency, hand and machine polishing are necessary and may result in the removal of as much as 0.01 inch of stock per surface. This type of heavy stock removal is tantamount to regrinding and regenerating the entire shape of the part, altering the complex three-dimensional, as-forged geometry, thereby negating the painstakingly achieved precision geometry of the forging dies.

Furthermore, because of the variable adherence of the oxidation layers to the billet surface, some of the oxide layer will flake off. Some of these flakes may be impacted randomly into the forged part by the forging pressures, as described above, further aggravating the surface irregularity problem. Other scale residue may be left in the forging dies. Such residue can be driven into the next forging billet, creating surface irregularities therein. In order to avoid this accumulation of oxide scale in the forging dies, expensive automatic blow-off and vacuum collection systems have been necessitated.

Efforts have previously been made to inhibit the formation of oxide scale during the heating of forging billet stock to forging temperature by treatment of the billet stock prior to heating it to the forging temperature. Thus, commercially available scale preventive coatings, such as glass/alcohol coatings and graphite/water coatings, have been utilized on billet stock. However, such commercially available coatings have, generally, been found to be ineffective in preventing scale formation during heating for forging. Also, they are relatively difficult to apply to billet stock, require drying or curing after application, and can be relatively easily rubbed off by handling.

SUMMARY OF THE INVENTION

It is a general object of the invention to provide an improved method of treatment of ferrous forging billet stock to inhibit the formation of oxidation scale thereon during heating for forging, which method avoids the disadvantages of prior techniques while affording additional operating advantages.

An important feature of the invention is the provision of a method of the type set forth which has a relatively high benefit to cost ratio and is easy to perform.

In connection with the foregoing feature, another feature of the invention is the provision of a method of the type set forth, which does not involve the use of liquid coatings on the billet stock.

Another feature of the invention is the provision of a method of the type set forth, which substantially inhibits the formation of oxide scale on the surface of the billet stock.

In connection with the foregoing feature, a further feature of the invention is the provision of the method of the type set forth, which minimizes the thickness of oxide layers formed on the surface of the billet stock.

A still further feature, in connection with the foregoing features, is the provision of a method of the type set forth, which results in a consistent and uniform oxide thickness on the surface of the billet stock.

Yet another feature of the invention is the provision of a method of the type set forth, which results in increased adherence of the oxide layer formed on the surface of the billet stock.

A further feature of the invention is the provision of a method of the type set forth, which results in a forged part with improved surface quality and uniformity.

Certain ones of these and other features of the invention are attained by providing a method of treating ferrous material to be forged, which may have oxidation scale on the surface thereof to inhibit the formation of oxides during heating for forging, the method comprising: removing oxidation scale from the surface of the material to form a cleaned surface, and forming on the cleaned surface a tightly adhering deposit of aluminum oxide.

Further features of the invention are attained by providing a method of treating ferrous material to be forged, which may have oxidation scale on the surface thereof to inhibit the formation of oxides during heating for forging, the method comprising: removing oxidation scale from the surface of the material to form a cleaned surface, roughening the cleaned surface, and embedding particles of aluminum oxide in the cleaned and roughened surface of the material.

A still further feature of the invention is attained by providing a method of treating ferrous material to be forged, which may have oxidation scale on the surface thereof to inhibit the formation of oxides during heating for forging, the method comprising: grit blasting the material by impacting on the surface thereof a pneumatically propelled stream of aluminum oxide grit, the stream of aluminum oxide grit being propelled at a pressure and for a time period sufficient to remove oxidation scale from the surface of the material and to form thereon a tightly adhering deposit of aluminum oxide particles.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWING

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
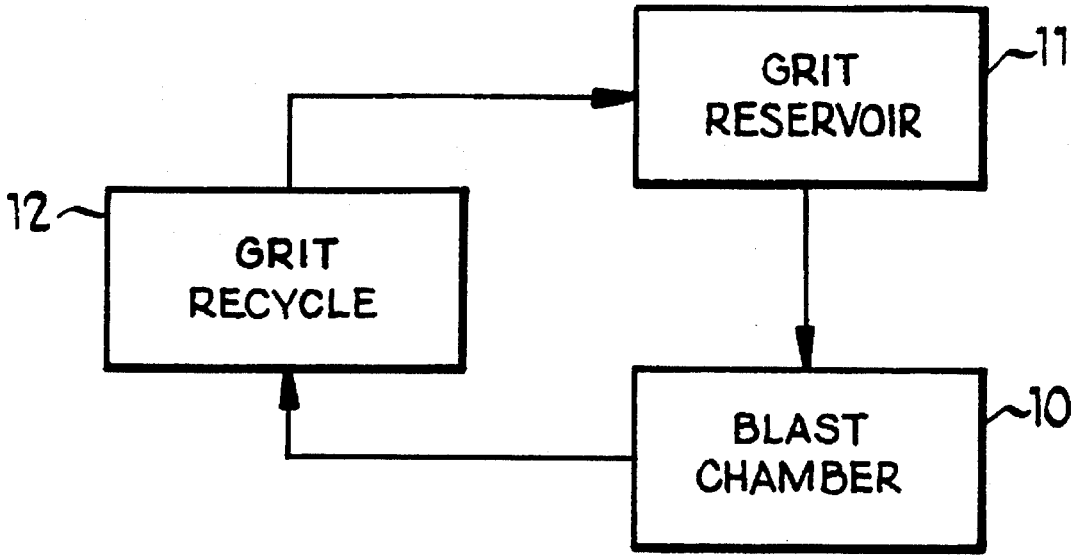
FIG. 1 is a functional block diagram illustrating the method of the present invention.

The method of the present invention fundamentally comprises grit blasting the surface of the ferrous forging billet stock with an aluminum oxide grit, a grit medium not heretofore used for mill scale removal. More specifically, referring to FIG. 1, the ferrous forging billet stock is supported in a blast chamber 10 by suitable means and the surface thereof is then impacted with a pneumatically-propelled aluminum oxide grit medium from a grit reservoir 11. Spent particles of the aluminum oxide grit medium are then collected from the blast chamber 10 and recycled, as at 12, to the grit reservoir 11.

A significant aspect of the present invention is the use of an aluminum oxide grit blasting medium for the removal of mill scale from ferrous forging billet stock, and, more particularly, use of such grit blasting as a treatment of the surface of the billet stock to inhibit the formation of further oxidation scale thereon as a result of subsequent heating of the forging billet to forging temperature. Thus, it has been found that grit blasting of the surface of ferrous forging billet stock with an aluminum oxide grit medium, under the conditions of the present invention, results in a significant inhibition of the formation of oxide scale on the surface of the billet stock during subsequent heating for forging. The method of the present invention involves the following physical changes in the billet stock:

(a) removal of any existing mill scale from the surface of the billet;

(b) abrasion or roughening of the surface of the billet with consequent increase in the surface area thereof; and (c) embedment of a dispersion of coarse and fine aluminum oxide particles in the roughened surface of the billet to form an aluminum oxide deposit thereon.

More specifically, the removal of existing mill scale cleans the surface of the billet stock and permits the abrasion and roughening thereof as a result of cold working by the impacts of the aluminum oxide particles. This roughening, in turn, enhances the embedment of aluminum oxide particles in the cleaned ferrous surface of billet stock, resulting in a firmly adhering deposit of dispersed aluminum oxide particles on the surface of the billet. This deposit has been found to result in significantly reduced formation of iron oxide scale on the surface during heating to forging temperature. Thus, while some scale still does form during heating, the scale layer is substantially thinner, of substantially more uniform thickness, and has a substantially greater adherence, than is the case with scale formed on billet stock which has not been subjected to the treatment of the present invention.

It has been found that the method of the present invention achieves satisfactory results over a relatively wide range of process parameters. The aluminum oxide grit medium may be any of a number of commercially available media, such as a brown, 96.15% aluminum oxide medium of the type sold by Sinclair Mineral & Chemical Co. under the trade name "EXOLON FASTBLAST," or a white, 99.75% aluminum oxide grit medium of the type sold by Sinclair Mineral & Chemical Co. under the trade name "EXOLON WP." Good results are obtained with grit sizes in the range of from about 80 grit to about 54 grit (corresponding to the particle thicknesses in the range of from about 100 microns to about 180 microns). Within this range it does not appear that grit size has a significant effect on the efficacy of the treatment. Other grit sizes may be used, but their effectiveness may be diminished. Significant improvement in oxide formation has been achieved with grit blast pressures ranging from about 60 psi to about 160 psi, but the preferred blast pressure is substantially 120 psi. Significant improvement in oxide formation has been achieved with grit blasting for time periods ranging from 30 seconds to 60 seconds, but the preferred time period is substantially 60 seconds. In general, it has been found that an effective blast time is inversely proportional to the blast pressure.

It has also been found that the temperature to which the billet is heated and the rate at which it is heated significantly affect the amount of oxide scale formation, irrespective of the particular process parameters used. Thus, in general, the amount of scale formation is directly proportional to the temperature to which the billet is heated and, at higher temperatures, the amount of oxide formed is proportional to the heating time. Accordingly, in general, it is desirable to forge at the lowest practical temperature, to heat the billet to that temperature as rapidly as possible and to minimize the length of time the billet is at that temperature in order to maximize the scale inhibition effect of the method of the present invention. However, regardless of the heating conditions, use of the treatment of the present invention with parameters anywhere within the above-listed ranges, invariably results in improved scale resistance as compared to untreated stock.

Sedimentation analysis of the grit medium reveals that a large number of fine particles are generated during the grit blasting operation. This indicates rounding or splintering of particles on impact. Since the spent grit medium is recycled, this results in a bimodal distribution of fine and coarse grit as the grit blasting operation proceeds and, therefore, grit particles of a variety of sizes are deposited on the surface of the billet to form the aluminum oxide deposit thereon. The particles making up the deposit are dispersed substantially randomly over the treated surface of the billet stock.

Figure 2A:
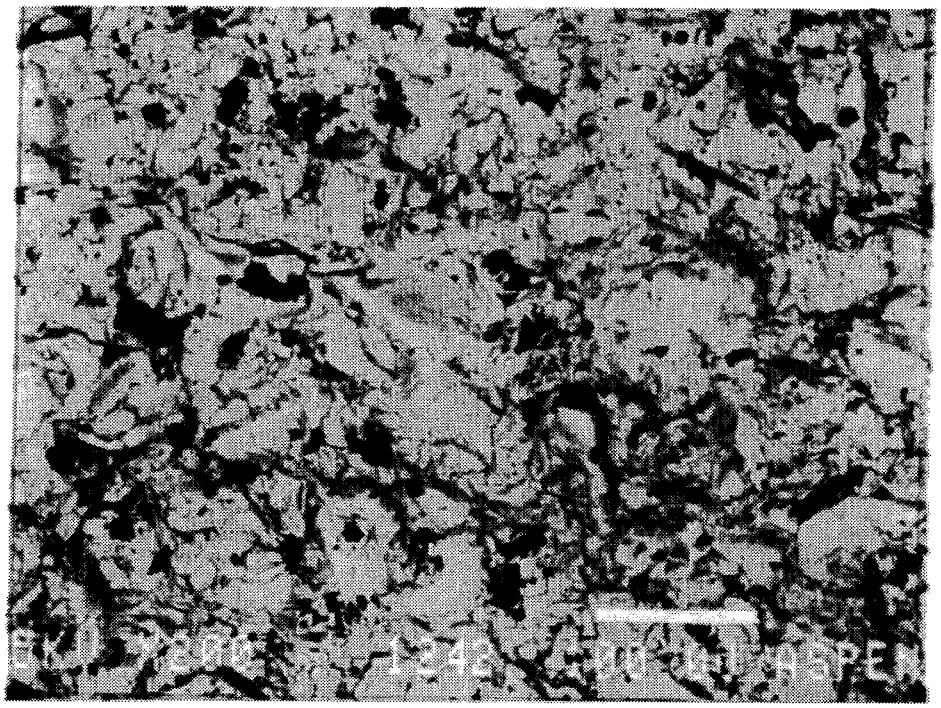
FIGS. 2A and 2B are photomicrographs of the surface of two ferrous billet after application respectively thereto of two versions of the method of the present invention.
Figure 2B:
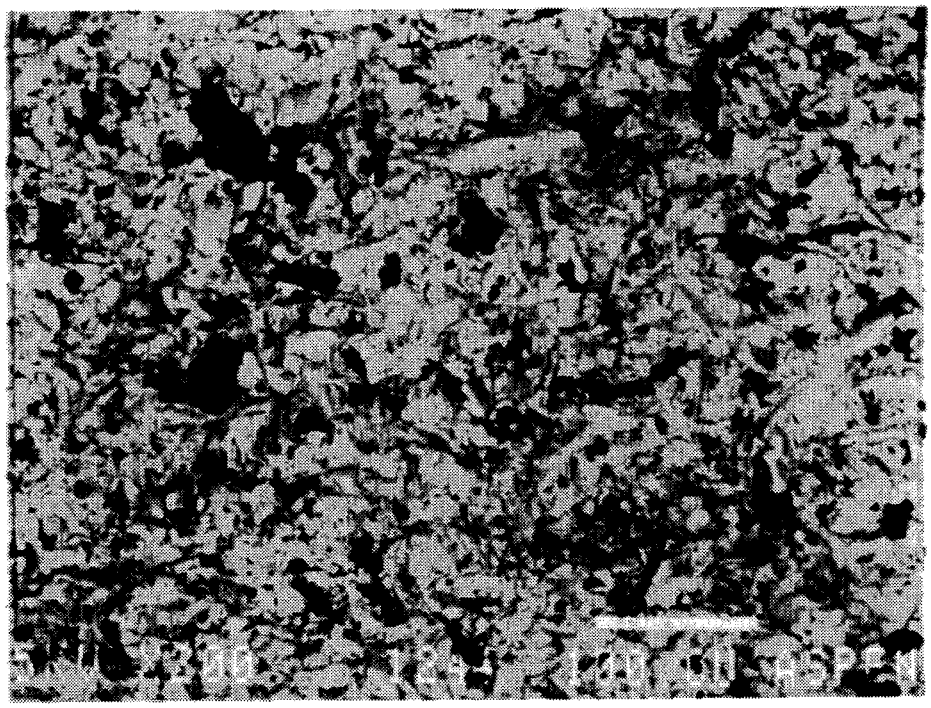

FIGS. 2A and 2B are backscatter images of 200× scanning electron micrographs (SEM) of the surfaces of two billets respectively treated with different versions of the method of the present invention, with the dark areas indicating the aluminum oxide particles making up the deposit on the surface of the billet stock. Measurement reveals that the aluminum oxide deposit makes up 18.2% of the surface area of the sample of FIG. 2A and 20% of the surface area of the sample of FIG. 2B. It is believed that, for effective results, the aluminum oxide deposit should cover at least 10% of the treated surface area of the billet stock. The sample of FIG. 2A was blasted with an aluminum oxide grit having an initial 54 grit size, while the sample of FIG. 2B was blasted with aluminum oxide particles having an initial 80 grit size. Both were blasted at a blast pressure of 120 psi for 60 seconds.

Figure 3:
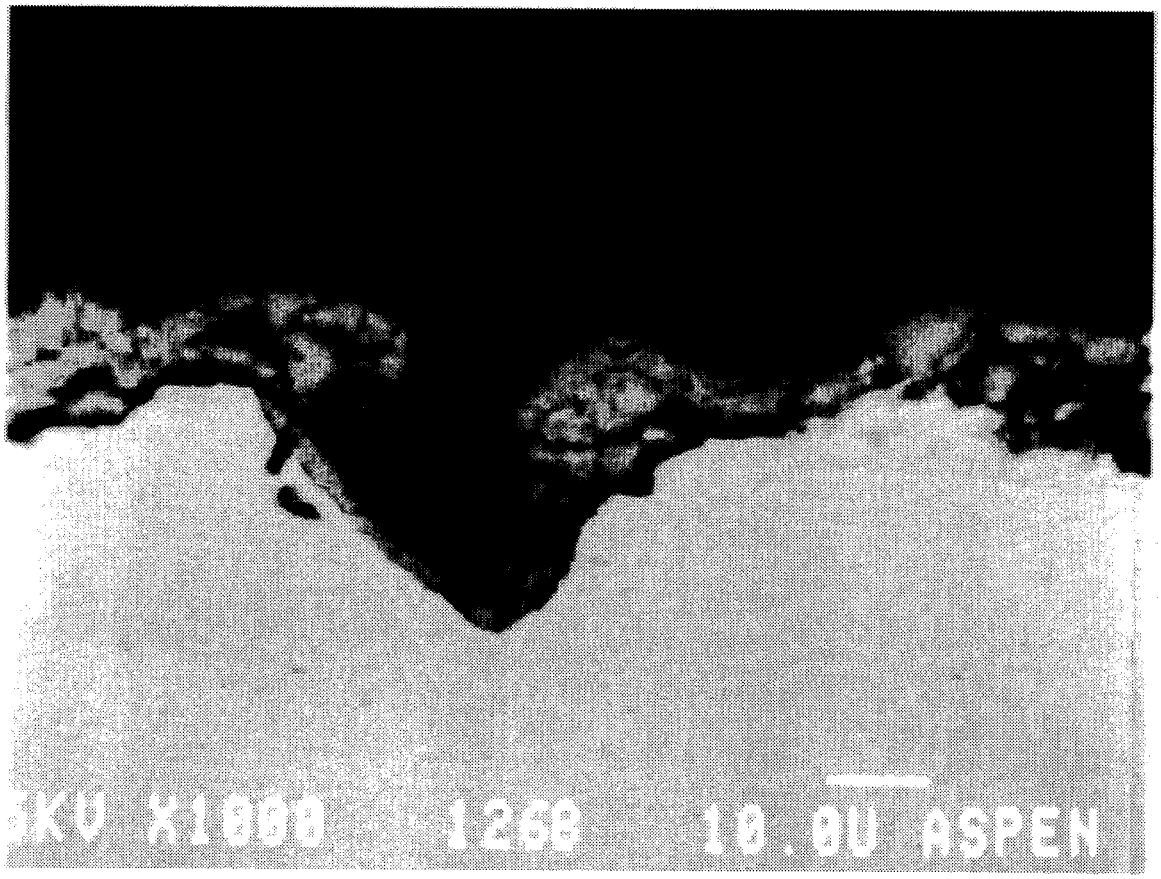
FIG. 3 is a photomicrograph of a transverse cross-section of the surface of a forging billet after being treated with the method of the present invention and then heated to 1850° F.

FIG. 3 is a backscatter image of a 1000× SEM of a transverse cross-section of the surface of billet stock after having been treated with the method of the present invention, with the large, generally V-shaped feature just left of center illustrating an aluminum oxide particle embedded in the steel substrate. The large particle has inhibited diffusion of the oxide scale as indicated by oxide growth (light-colored regions) being only partially around and through cracks in the particle. The white line 15 is a scale reference line and measures 10 microns. It can be seen that the aluminum oxide particle is embedded over 20 microns (approximately 0.0008 inch) into the surface of the steel substrate. It will be appreciated that the depth of embedment of aluminum oxide particles will vary with the size of the particles and with the blast pressure and can range from about 1 to about 50 microns. It is a significant aspect of the invention that this embedment results in a very tightly adhering deposit of aluminum oxide on the billet surface, which deposit cannot easily be removed and which will survive normal handling.

A number of ferrous forging billets were mounted in a blast chamber and subjected to grit blasting in accordance with various versions of the present invention. Each forging billet, in the nature of an elongated cylindrical bar 11/16-inch in diameter, was mounted in the blast chamber for rotation about its longitudinal axis while being traversed longitudinally by a single grit blasting nozzle. However, it will be appreciated that other mounting and blasting arrangements could be used, as long as substantially uniform exposure of the entire surface of the billet to the grit blasting medium is achieved. The following examples illustrate the process of the present invention and are directed to describing its preferred aspects relating to the treatment of a ferrous forging billet. However, these examples are not intended to unduly limit the broad scope of the present invention.

EXAMPLE I

Six ferrous forging billets meeting the AISI 50B44 alloy steel chemical requirements were subjected to the treatment of the present invention, as illustrated in FIG. 1, by grit blasting with aluminum oxide grit having a pre-blasting 54 grit size meeting ANSI B74.12 size requirements. The blast medium was pneumatically impacted on the surface of each billet with a blast pressure of 120 psi for 60 seconds. FIG. 2A is a photomicrograph of the surface of the billet after this treatment in accordance with the present invention. FIG. 3 is a photomicrograph of a transverse cross-section of the surface of this billet after this treatment in accordance with the present invention and after subsequent induction heating to 1850° F.

EXAMPLE II

This example is the same as Example I, except the billets were grit blasted for 30 seconds.

EXAMPLE III

This example is the same as Example I, except that the billets were grit blasted at a blast pressure of 80 psi.

EXAMPLE IV

This example is the same as Example III, except that the billets were grit blasted for 30 seconds.

EXAMPLE V

This example is the same as Example I, except that the grit medium was an aluminum oxide grit having a pre-blasting 80 grit size. The photomicrograph of FIG. 2B illustrates the surface of the billet after this treatment in accordance with the invention.

EXAMPLE VI

This example is the same as Example V, except that the billets were grit blasted for 30 seconds.

EXAMPLE VII

This example is the same as Example V, except that the billets were grit blasted at a blast pressure of 80 psi.

EXAMPLE VIII

This example is the same as Example VII, except that the billets were grit blasted for 30 seconds.

After treatment of the billets in accordance with Examples I–VIII above, the six treated billets from each Example were heated to three different forging temperatures at two different heating rates in a 12-station induction heating unit. In particular, for each Example, one billet was heated to 1700° F. at a fast rate of 7 seconds per station, one treated billet was heated to 1700° F. at a slow heating rate of 9 seconds per station, two treated billets were heated to a temperature of 1850° F., respectively at the fast and slow rates, and two treated billets were heated to 2000° F., respectively at the fast and slow rates. The billets thus treated with the method of the present invention and heated were compared with six untreated hot rolled billets, as received from the mill, and six centerless ground billets, which were subjected to the same pre-forge heating regimens.

It was found that all billets that were blasted with aluminum oxide have thinner oxide layers than hot rolled or centerless ground units, irrespective of grit-blasting parameters or the induction heating parameters. The lowest average oxidation level (0.0002–0.0010 inch) was achieved with billets blasted with 50 grit or 80 grit aluminum oxide and heated to either 1700° F. or 1850° F. The oxide layers that were formed on the billets untreated with the aluminum oxide blasting had an average oxide thickness of 0.0022–0.00258 inch. Also, the variability of the thickness of the oxide layers was found to be greater in the un-blasted billets than with those subjected to the aluminum oxide blasting of the present invention. In general, as the temperature is increased, the oxide thickness increases. Billets blasted with aluminum oxide in accordance with the present invention do not show a significant change in oxidation between 1700° F. and 1850° F., but increasing the temperature to 2000° F. dramatically increases oxidation. The induction heating rate did not significantly affect oxide levels of aluminum oxide blasted billets between 1700° F. and 1850° F. However, a significant reduction in oxide thickness was achieved by fast induction heating aluminum oxide-blasting billets as compared to slow induction heating to the 2000° F. temperature. The oxide formed on aluminum oxide-blasted at 1700° F. and 1850° F. is not only reduced in thickness, but also has a finer structure as compared to the oxide formed on the non-blasted billet stock.

The reason why, or the mechanism by which the aluminum oxide blasting treatment of the invention achieves the significantly reduced oxide formation described above, is not fully understood. It is believed that one operative mechanism may be that the cleaning and roughening of the surface of the billet stock changes the nucleation mechanism for the growth of oxides. The roughening as a result of cold working of the surface by the aluminum oxide particles significantly increases the numbers of nucleation sites. The oxides of iron grow epitaxially on the billet surface and the greater number of nucleation sites may help pin oxide grain boundary movement, which movement would otherwise break the epitaxial relationship and reduce scale adhesion. The finer, more dense oxide formed may also inhibit diffusion or, alternatively, the increase in diffusion which would normally be expected to follow from finer oxide structure may be temporarily restrained by the pinning effect of increased nucleation sites. In any event, the fine-grained thinner oxide produced should have greater plasticity, thereby improving scale adhesion.

Also, the particles of aluminum oxide residing on and embedded in the surface of the billet as a result of the grit-blasting treatment, may provide localized diffusion barriers for the oxidation and may also help pin oxide grains, restraining oxide growth.

Additionally, the aluminum oxide particles deposited on the billet surface may also enhance oxide adherence by a vacancy sink mechanism. Atomic vacancies due to metal outward diffusion cause void formation at the metal/scale interface and resultant flaking or spalling of the oxide after extended time at temperature. The blasting with aluminum oxide imparts dislocations and particles into the surface, which increase the number of vacancy "sinks," or areas to absorb vacancies and resultant voids.

From the foregoing, it can be seen that there has been provided an improved method for the treatment of ferrous forging billet stock which significantly inhibits the formation of oxide scale on the surface of the billet stock during heating for forging, the method consisting essentially of grit blasting the surface of the billet with aluminum oxide grit under conditions such that any pre-existing oxidation scale is removed and a tightly-adhering deposit of aluminum oxide particles is formed on the cleaned billet surface.

I claim:

1. A method of treating ferrous material to be forged, which may have oxidation scale on the surface thereof, to inhibit the formation of oxides during heating for forging, said method comprising: removing oxidation scale from the surface of the material to form a cleaned surface, and forming on the cleaned surface a deposit of aluminum oxide which covers at least 10 percent of the area of the cleaned surface.

2. The method of claim 1, wherein the formation of the aluminum oxide deposit occurs substantially simultaneously with the removal of oxidation scale from the surface of the material.

3. The method of claim 1, wherein the deposit of aluminum oxide includes particles of aluminum oxide dispersed over the surface of the material.

4. The method of claim 3, wherein the aluminum oxide deposit includes particles having sizes in the range of from less than one micron to about 50 microns.

5. The method of claim 1, wherein the removing of oxidation scale and the forming of an aluminum oxide deposit are effected by grit blasting the surface of the material with a stream of aluminum oxide grit.

6. A method of treating ferrous material to be forged, which may have oxidation scale on the surface thereof, to inhibit the formation of oxides during heating for forging, said method comprising: removing oxidation scale from the surface of the material to form a cleaned surface, roughening the cleaned surface, and embedding particles of aluminum oxide in the cleaned and roughened surface of the material so that the aluminum oxide particles cover at least 10 percent of the area of the cleaned surface.

7. The method of claim 6, wherein the removing of oxidation scale from the surface of the material and the embedding of aluminum oxide particles therein occur substantially simultaneously.

8. The method of claim 6, wherein the aluminum oxide particles are dispersed over the surface of the material.

9. The method of claim 8, wherein the aluminum oxide deposit includes particles having sizes in the range of from less than one micron to about 50 microns.

10. The method of claim 6, wherein the removing of oxidation scale and the forming of an aluminum oxide deposit are effected by grit blasting the surface of the material with a stream of aluminum oxide grit.

11. A method of treating ferrous material to be forged, which may have oxidation scale on the surface thereof, to inhibit the formation of oxides during heating for forging, said method comprising: grit blasting the material by impacting on the surface thereof a pneumatically propelled stream of aluminum oxide grit, said stream of aluminum oxide grit being propelled at a pressure and for a time period sufficient to remove oxidation scale from the surface of the material and to form thereon a deposit of aluminum oxide particles which covers at least 10 percent of the area of the cleaned surface.

12. The method of claim 11, wherein the aluminum oxide grit includes particles having an initial pre-blasting size in the range from about 100 microns to about 180 microns.

13. The method of claim 11, wherein the aluminum oxide grit is propelled at a pressure in the range of from about 60 psi to about 160 psi.

14. The method of claim 13, wherein the aluminum oxide grit is propelled at a pressure of substantially 120 psi.

15. The method of claim 11, wherein the aluminum oxide grit is impacted on the material for a time period in the range of from about 30 seconds to about 60 seconds.

16. The method of claim 15, wherein said time period is substantially 60 seconds.

17. The method of claim 11, wherein the aluminum oxide grit is propelled at a pressure in the range from about 60 psi to about 160 psi, and the aluminum oxide grit is impacted on the material for a time period in the range of from about 30 seconds to about 60 seconds.

18. The method of claim 11, wherein at least some of the aluminum oxide particles are fractured upon impact with the surface of the material, and further comprising the step of recycling the aluminum oxide grit, said particles of said deposit being embedded in the surface of the material so as to be tightly adherent thereto and having thicknesses in the range of from less than one micron to about 50 microns.

* * * * *